US006708576B2

(12) United States Patent
Oechslin

(10) Patent No.: US 6,708,576 B2
(45) Date of Patent: Mar. 23, 2004

(54) ESCAPEMENT FOR A TIMEKEEPER

(75) Inventor: Ludwig Oechslin, Lucerne (CH)

(73) Assignee: Ulysse Nardin S.A., Le Locle (CH)

( * ) Notice: Subject to any disclaimer, the term of this patent is extended or adjusted under 35 U.S.C. 154(b) by 62 days.

(21) Appl. No.: 10/021,065

(22) Filed: Dec. 19, 2001

(65) Prior Publication Data

US 2002/0088295 A1 Jul. 11, 2002

(30) Foreign Application Priority Data

Jan. 9, 2001 (EP) ..... 01200043

(51) Int. Cl.[7] ..... G04B 15/00

(52) U.S. Cl. ..... 74/1.5; 74/437; 74/84 R; 368/127; 368/132

(58) Field of Search ..... 74/1.5, 84 R, 437; 368/127, 132, 133, 161, 169

(56) References Cited

U.S. PATENT DOCUMENTS 2,354,020 A * 7/1944 Honger ..... 368/169
2,977,750 A * 4/1961 Biemiller et al. ..... 368/169
3,143,848 A * 8/1964 Biemiller et al. ..... 368/130
3,182,426 A * 5/1965 Haydon ..... 451/222
3,845,616 A * 11/1974 Jeanmairet et al. ..... 368/169
6,301,981 B1 * 10/2001 Oechslin ..... 74/1.5

FOREIGN PATENT DOCUMENTS

DE 24 58 503 A 6/1976
EP 1 041 459 A 10/2000

* cited by examiner

*Primary Examiner*—David A. Bucci
*Assistant Examiner*—Bradley J. VanPelt
(74) *Attorney, Agent, or Firm*—Sughrue Mion, PLLC

(57) ABSTRACT

The escapement includes first (3) and second (4) escapement wheels meshing with each other, one of these wheels being driven by the gear train. It further includes a lever (5) capable of receiving the impulses generated alternately by the first and second wheels and to transmit these impulses to a plate (2) which carries a sprung-balance. The lever is arranged to lock alternately the first and second wheels after each impulse transmitted.

6 Claims, 5 Drawing Sheets

ESCAPEMENT FOR A TIMEKEEPER

The present invention relates to an escapement arranged between a gear train and a plate to which is attached a balance of a timekeeper, the balance being able to travel through a free arc of oscillation and to receive pulses for maintaining the oscillations, this escapement including first and second toothed wheels meshing with each other, one of such wheels being driven by the gear train.

The Applicant of the present invention has already proposed an escapement answering the definition which has just been given and a description of which is set out in European Patent No. -A-1 041 459. This document discloses an escapement including first and second wheels meshing with each other. One of these wheels is driven by the gear train. First and second plates secured to a common shaft support a sprung-balance. The wheels and the first plate are provided with means allowing said first plate to receive direct pulses delivered alternately by the first and second wheels for the purpose of maintaining the balance oscillations. The second plate is provided with means for driving a locking lever arranged to lock said first and second wheels alternately.

The present invention thus takes up an essential feature of that which is described in the aforecited document, namely two wheels meshing with each other, one of these wheels being driven by the gear train. However, the idea developed in the aforecited document of using two superposed plates, one used to receive direct pulses provided alternately by the first and second wheels, and the other used to lock alternately, via a lever, said first and second wheels, has been abandoned in the present invention for obvious purposes of simplifying the mechanism.

As will be seen in the following description, a single plate supporting the sprung-balance co-operates with a lever which in turn and alternately co-operates with the first and second wheels. It will thus be understood that the entire escapement mechanism is contained in a single plane and that the space requirement of the mechanism in height is halved with respect to the space occupied by the escapement of the aforecited document.

Thus, the escapement of the present invention is characterised in that it further includes a lever able to receive pulses generated alternately by the first and second wheels and to transmit these pulses to the plate to drive it in rotation and to maintain the oscillations of the balance, said lever being arranged to lock said first and second wheels alternately after each impulse transmitted.

It will thus have been understood that the lever of the invention fulfils a dual function: first of all that of transmitting the pulses received alternately from the first and second wheels to the plate and then that of locking said wheels alternately after each impulse.

The invention will be explained in detail hereinafter by an embodiment given by way of example, this embodiment being illustrated by the annexed drawings, in which.

Figure 1:
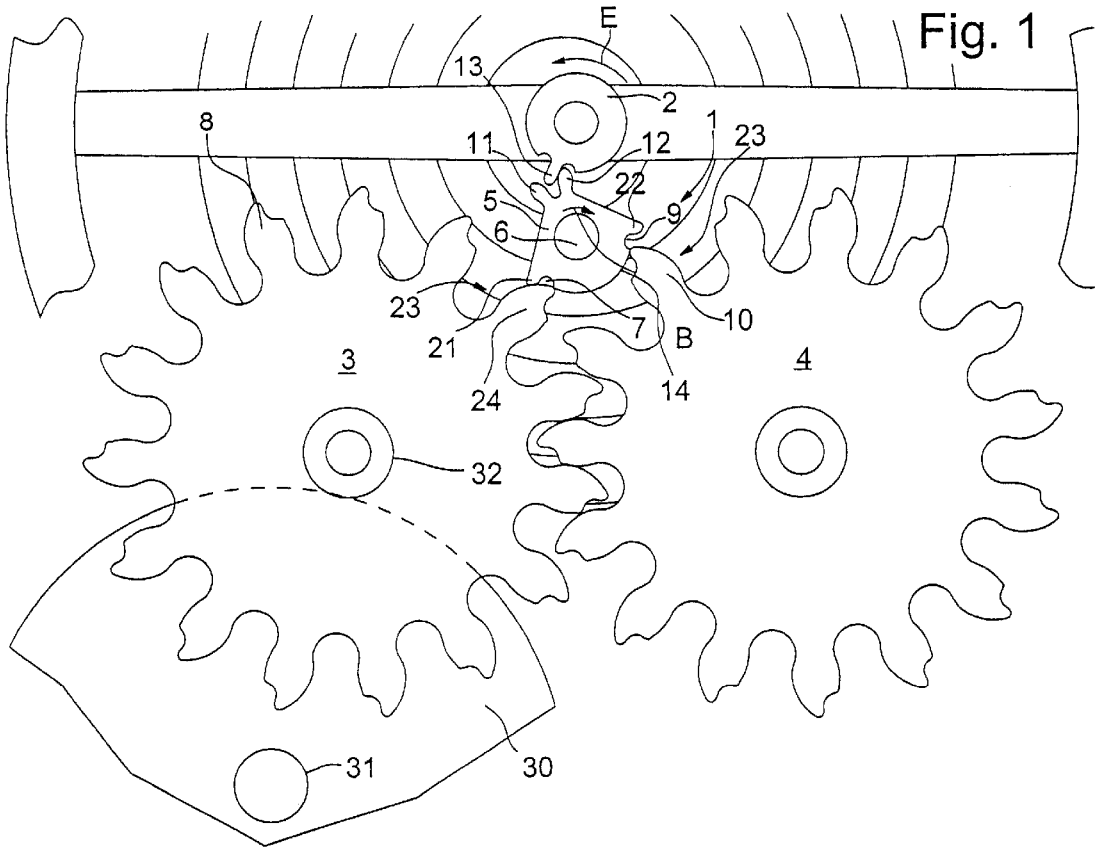
FIGS. 1 to 6 are plan views of the escapement according to the invention, shown in six different stages showing a complete oscillation of the balance.

FIGS. 1 to 6 are plan views of six successive phases of the escapement of the invention, these phases covering a complete oscillation of the sprung-balance. Escapement 1 is arranged, as is usual, between a gear train and a plate 2 supporting a sprung balance of a timekeeper. The sprung-balance, which is not shown in the Figures, is able, as is known, to travel through a free arc of oscillation and is arranged to receive pulses for maintaining such oscillations. By definition, the gear train, also called the going train, is the set of wheels and pinions which, from a barrel, transmits the driving force to an escapement wheel. In FIG. 1, the gear train is represented by its last wheel 30, associated with pinion 31. Wheel 30 drives a first escapement 3 via pinion 32 which is secured thereto. First wheel 3 meshes with a second wheel 4. Wheels 3 and 4 have the same diameter and the same number of teeth. It will be noted here that going train wheel 30 could drive second escapement wheel 4 instead of first wheel 3.

The foregoing is known from European Patent No. A-1 041 459 which already shows an escapement including two wheels meshing with each other and arranged to transmit direct pulses to a first plate while a second plate drives a lever locking in turn the first and then the second escapement wheel.

Compared to this prior arrangement, the present invention is characterised in that it includes a lever 5 able to receive pulses generated alternately by the first and second escapement wheels 3 and 4 as is shown clearly in the Figures accompanying this description. Generally speaking, these Figures demonstrate the fact that lever 5, in turn, transmits the received pulses to plate 2 to drive it in rotation so a to maintain the oscillations of the sprung-balance secured to plate 2. The same Figures also show that the lever is arranged to lock alternately the first and second escapement wheels 3 and 4, after each impulse has been transmitted to plate 2.

A preferred embodiment of the invention, which allows the escapement principle defined in the above paragraph, will now be described in more detail.

As the Figures show, lever 5 fitted to the escapement of the invention is supported by a shaft 6 pivoting freely in a plate (not shown) of the time-keeper. This lever 5 has a substantially triangular shape.

A first top of the lever includes a first recess 7 into which the end of a tooth 8 of the first wheel can be introduced to subject lever 5 to an impulse in a first direction A. This introduction situation is not shown in the drawing, but it will be understood that it follows the phase shown in FIG. 6.

A second top of the lever includes a second recess 9 into which the end of a tooth 10 of the second wheel 4 can be introduced to subject lever 5 to an impulse in a second direction B, opposite to direction A. This situation is shown in the drawing of FIG. 2 and in FIG. 7 which is an enlarged view of zone VII of FIG. 2.

Figure 2:
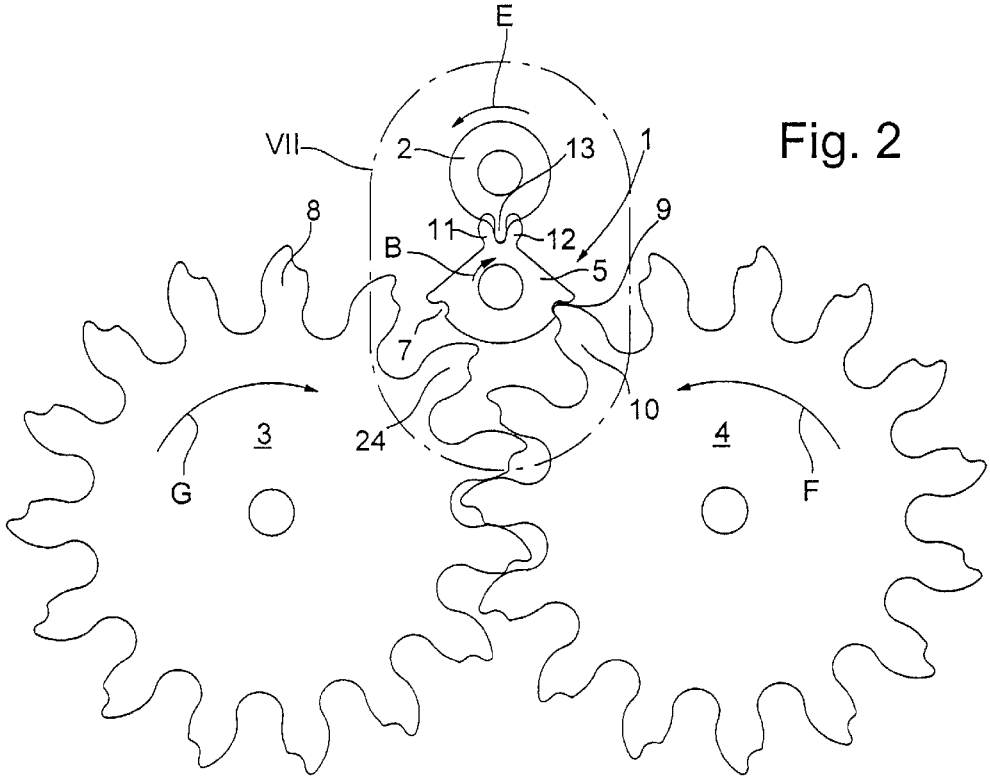
Figure 7:
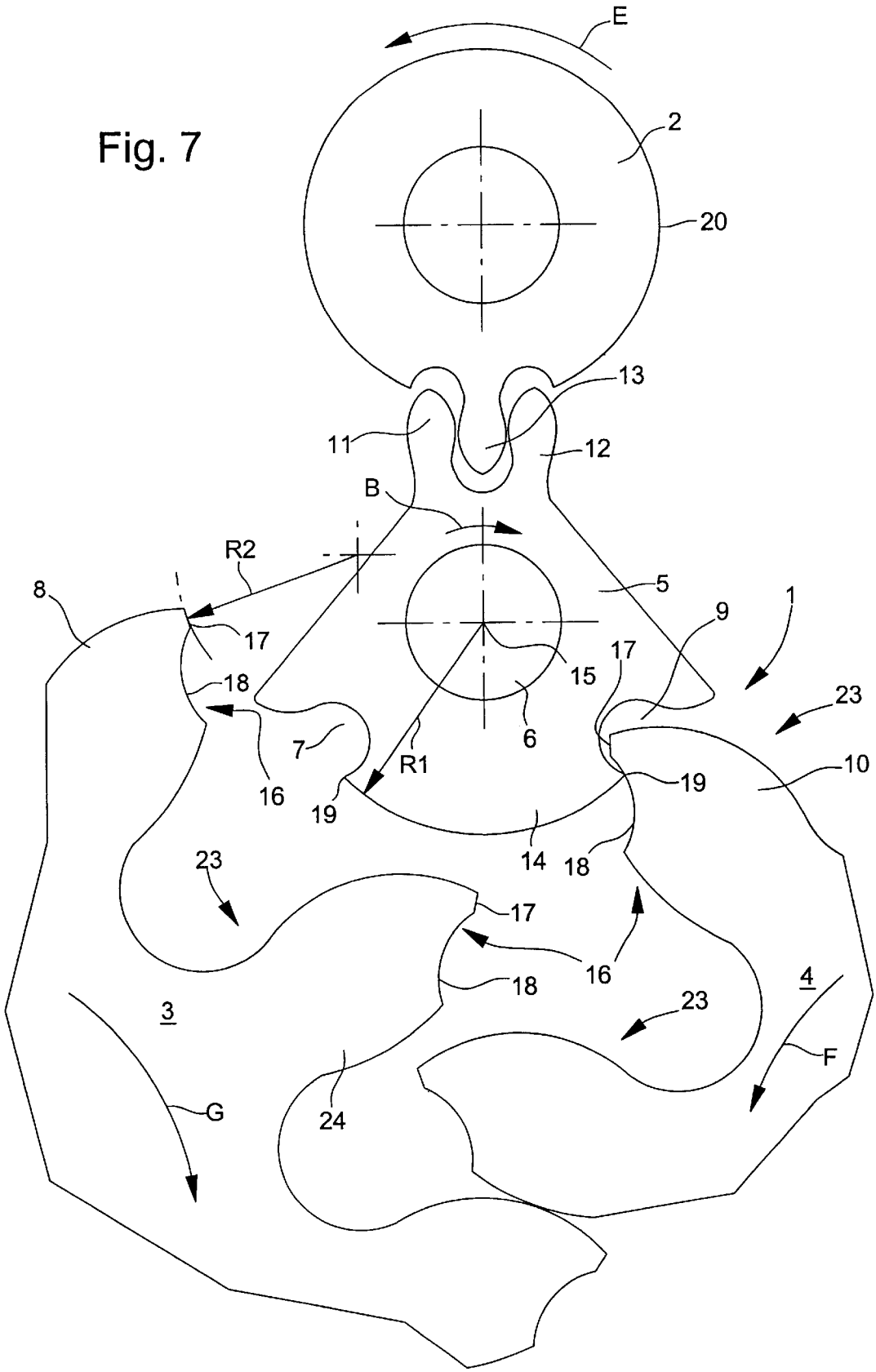
FIG. 7 is an enlarged view of zone VII shown in FIG. 2.

Finally, a third top of lever 5 includes two teeth 11 and 12 capable of meshing with a single tooth 13 of plate 2, a total meshing situation being clearly shown in FIGS. 2 and 7.

One will now explain how the teeth of the two wheels co-operate with lever 5 to subject said lever to pulses and to lock the same lever after each impulse transmitted.

Figure 8:
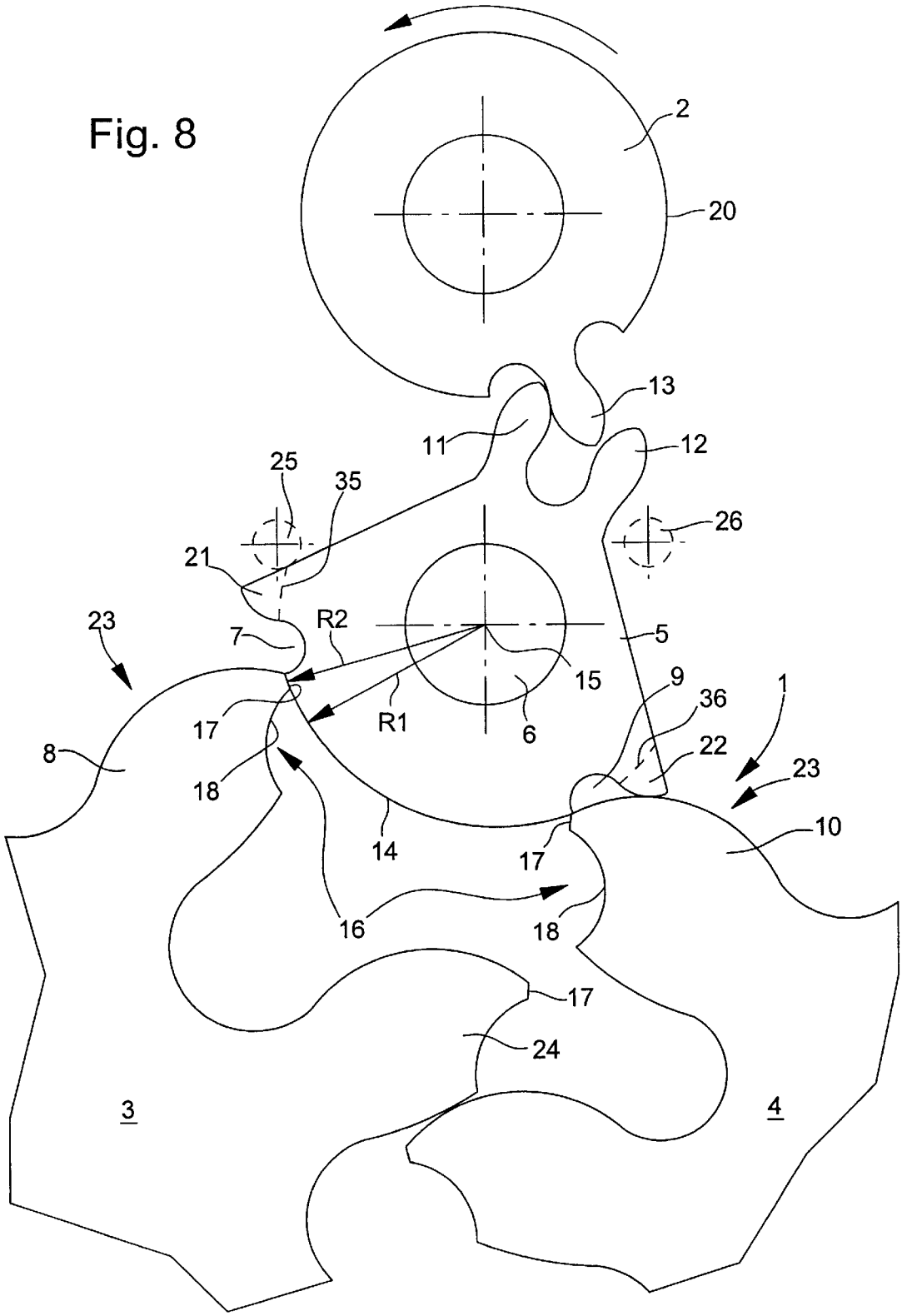
FIG. 8 is an enlarged view of zone VIII shown in FIG. 3.

It will be noted first of all, with reference to FIGS. 7 and 8, that the first and second recesses 7 and 9 of lever 5 are connected by an edge 14 having a circular configuration whose radius of curvature R1 passes through axis 15 of shaft 6 which supports lever 5. It will also be observed that the teeth of the first and second wheels 3 and 4 each have a working flank 16 defined as facing the respective direction of forward movement of each of the wheels. Each working flank 16 includes a first curved top cut out portion 17, called the locking face, whose radius of curvature R2 is substantially the same as radius of curvature R1 of edge 14 connecting first and second recesses 7 and 9 of lever 5. As FIG. 8 clearly shows, this locking face 17 abuts against the edge 14 of lever 5 to lock one of wheels 3 and 4, in this case wheel 3. A similar situation, locking wheel 4, is shown in FIG. 1. Each working flank 16 also includes a second cut out portion 18, in the shape of an arc of a circle, called the impulse face, this second cut out portion 18 following first cut out portion 17. As FIG. 7 clearly shows, this impulse face 18 abuts against an edge 19 defined as being the intersection of edge 14 of lever 5 and one of recesses 7 and 9 of the same lever, in this case recess 9. This abutment drives lever 5 in rotation in the direction of arrow B and consequently, drives plate 2 in the direction of arrow E. The impulse is thus given to the sprung-balance.

Figure 4:
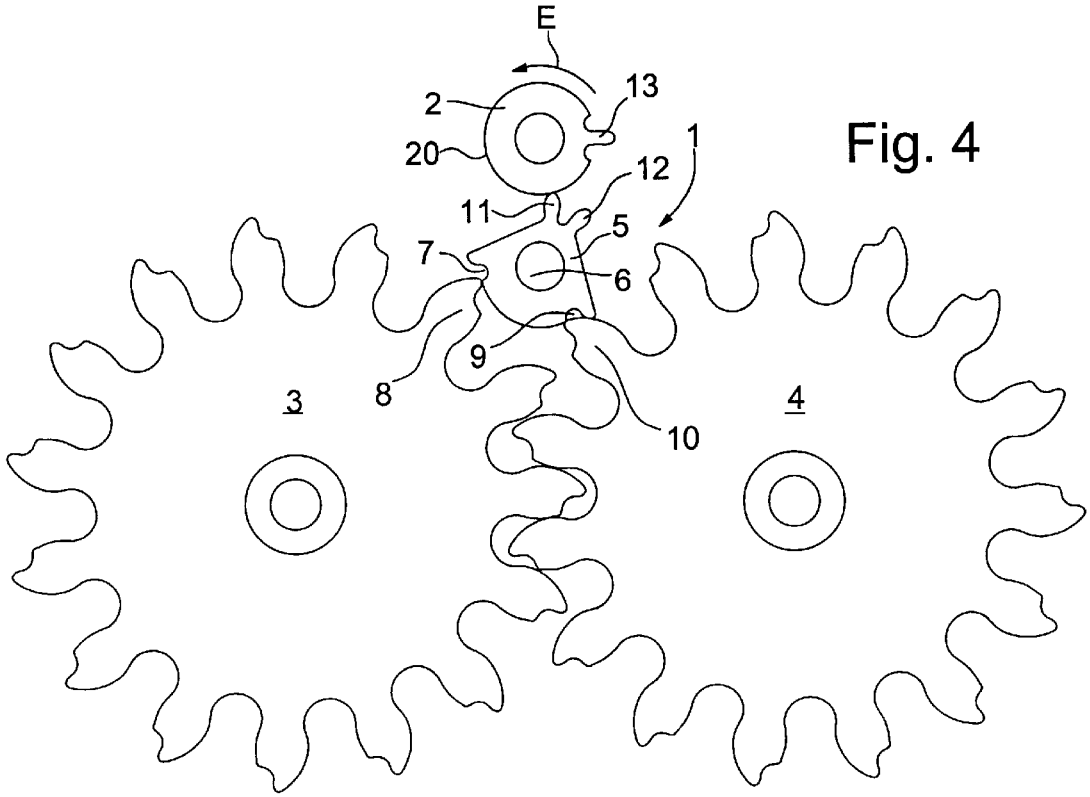
Figure 5:
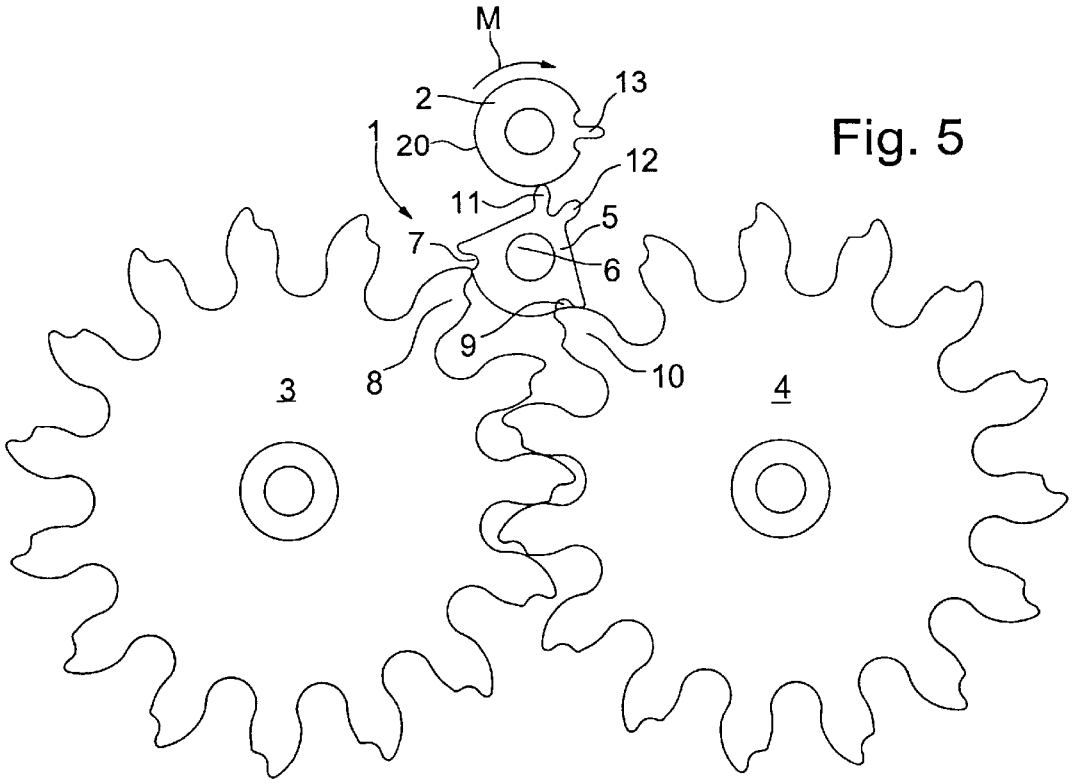

As it is important to prevent lever 5 overbanking (due for example to a shock) during the travel of the free arc of oscillation of the balance and thus of plate 2 to which it is secured, each of the two teeth 11 and 12 occupying the third top of lever 5 will be dimensioned so that they are contiguous with edge 20 of plate 2. Such situations are shown in FIGS. 4 and 5.

Finally, it will be understood that it is important to limit the angular travel of lever 5. This limitation can be achieved according to two different embodiments.

Figure 3:
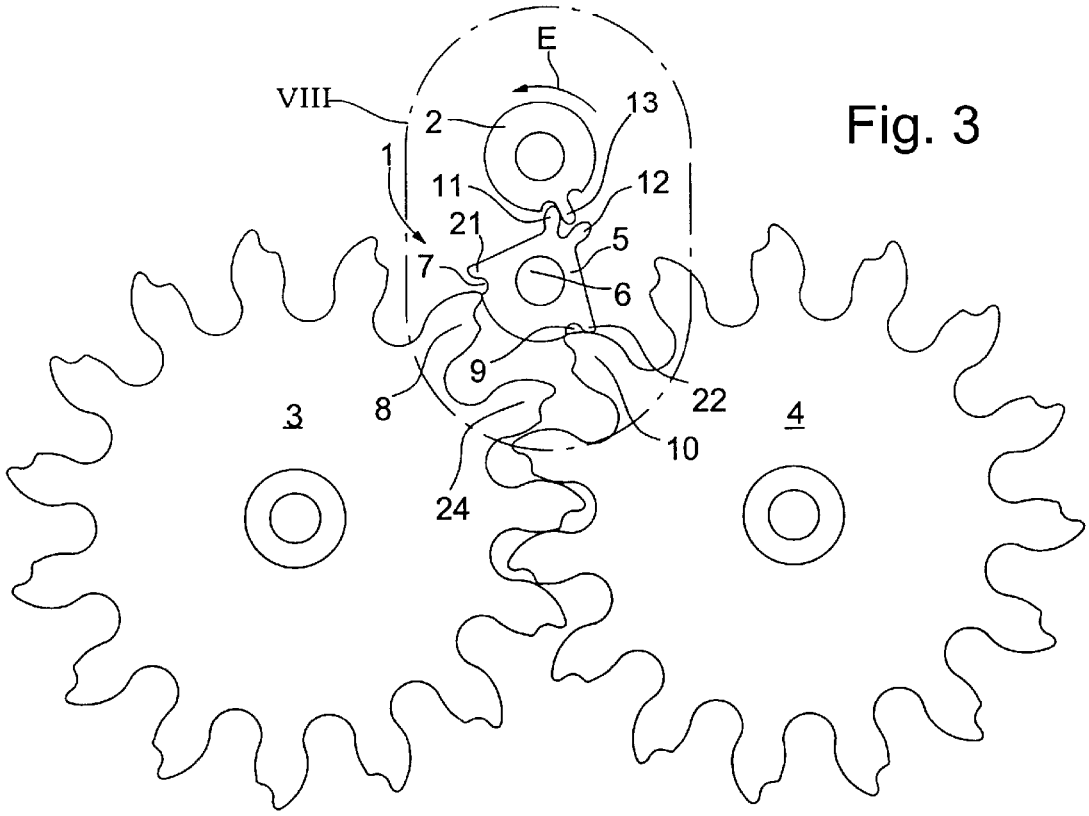

A first embodiment consists in providing the first and second tops of lever 5 with first and, respectively, second horns 21 and 22 as all the Figures shown and particularly FIG. 8. First horn 21 abuts against non-working flank 23 of a tooth 24 of the first wheel 3 as shown in FIG. 1. Likewise, second horn 22 abuts against the non-working flank of a tooth 10 of second wheel 4 as is seen in FIGS. 3 and 8. It is to be noted here that non-working flank 23 of the teeth in question is defined as that with its back to the respective direction of forward movement of each of the wheels.

A second embodiment consists in limiting the travel of lever 5 by means of two pins 25 and 26 driven into the time-keeper plate as is shown in dotted lines in FIG. 8. It will be understood that horns 21 and 22 fitted to lever 5 are no longer necessary and that they can be removed. At this moment the first and second tops of lever 5 could end along dotted lines 35, 36 respectively, which could be the extension of the edge in the shape of an arc of a circle 14 connecting recesses 7 and 9.

As a preferred embodiment of the new escapement and the functions fulfilled by the various parts forming it have been described hereinbefore, one will now examine its actual mode of operation by describing a complete working cycle. FIGS. 1 to 6, which show six important phases of the cycle, will be examined in turn.

First Phase (FIG. 1)

The mechanism is stopped. Second escapement wheel 4 is locked because the locking face of its tooth 10 rests on edge 14 connecting recesses 7 and 9 of lever 5. The angular travel of lever 5 is at the end of its travel since its horn 21 rests on the non-working flank 23 of tooth 24 of first escapement wheel 3. At this moment, the sprung-balance is close to the end of oscillation (arrow E) or close to the end of the second vibration of such oscillation. Tooth 13 of plate 2 enters into contact with tooth 12 of lever 5 and will drive said lever in the direction of arrow B. This is the lever release phase in which on the one hand horn 21 and edge 14 can slide on non-working flank 23 of tooth 24, and on the other hand edge 14 can be removed in front the locking face of tooth 10.

Second Phase (FIGS. 2 and 7)

Lever 5 continues its travel in the direction of arrow B, driven by plate 2. At this moment tooth 13 of the plate is totally engaged between the two teeth 11 and 12 of the lever. Tooth 10 of the second escapement wheel has penetrated recess 9 of the lever and impulse face 18 of tooth 10 enters into contact with edge 19 of the lever. Escapement wheel 4 is then driven in the direction of arrow F via escapement wheel 3 which rotates in the direction of arrow G which is in turn driven by the gear train the last element 30 of which was shown in FIG. 1. This is an impulse phase which launches the plate in the direction of arrow E and causes the lever to rotate in the direction of arrow B until the lever meets the locking face of a tooth of the first escapement wheel.

Third Phase (FIGS. 3 and 8)

When tooth 13 of plate 2 leaves tooth 11 of the lever, locking face 17 of tooth 8 of first escapement wheel 3 abuts against edge 14 of the lever thus locking first and second wheels 3 and 4. From this moment on plate 2 begins a second oscillation in the direction of arrow E. The lever is then held either by horn 22 which abuts against non-working flank 23 of tooth 10, or by pin 25 depending upon the limitation solution which has been selected.

Fourth Phase (FIG. 4)

The situation of the lever is the same as that described hereinbefore with the exception that its tooth 11 is contiguous with edge 20 of plate 2 to prevent any overbanking. The plate continues to rotate in the direction of arrow E and travels through the first vibration of its second free oscillation. Lever 5 and first and second wheels 3 and 4 are still locked.

Fifth Phase (FIG. 5)

After having travelled through its first vibration, the plate returns in the reverse direction shown by arrow M and travels through the second vibration of its second free oscillation. Lever 5 is still locking the first and second wheels and is still prevented from overbanking via the action of its tooth 11 against edge 20 of plate 2.

Figure 6:
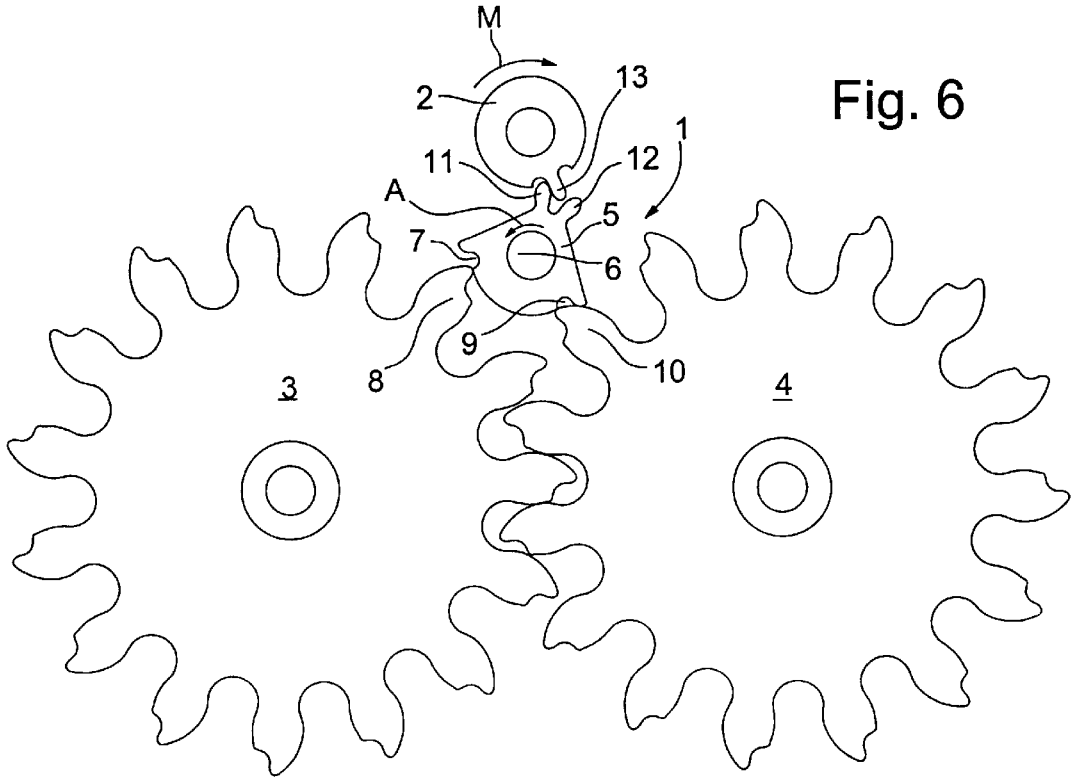

Sixth Phase (FIG. 6)

Tooth 13 of plate 2 enters into contact with tooth 11 of lever 5 which will drive the latter in the direction of arrow A. This is a similar situation to that illustrated by FIG. 1, i.e. at the beginning of a new release phase which will allow tooth 8 of first wheel 3 to be introduced into recess 7 of lever 5 to launch plate 2 again. From this sixth phase, a new cycle similar to that which has just been described, starts, the locking then acting on second escapement wheel 4.

Final Considerations

It was already indicated above that the escapement according to the invention takes very little place in height since all the parts involved (escapement wheels, lever, plate) are located on the same level in the same plane. It is also to be noted that this system uses fewer parts than those implemented in the escapement described with reference to the aforecited document EP-A-1 041 459, thus allowing a less expensive mechanism to be proposed. Moreover, the parts used are very simple which makes the assembly very reliable to operate.

It was seen that the impulse on lever 5 is given by a tooth 10 of one of escapement wheels 4 on an edge 19 made on lever 5 (see FIG. 7). The portion of tooth which gives this impulse is the second cut out portion 18 which has the shape of an arc of a circle. This is reminiscent of the detent escapement known in the state of the art and mainly used in chronometry. This method is very economical as regards energy used since the contact of the parts present is reduced to an edge rubbing against an arc of a circle. It will be noted however, that unlike the detent escapement, the escapement according to the invention is self-starting.

It will also be noted that the impulse is communicated to plate 2 by an intermediate part, called here lever 5. This is reminiscent of the Swiss lever escapement where the impulse is transmitted to the plate by a fork. The Swiss lever escapement has however a drawback, namely the recoil of the escapement wheel at the moment of release, such recoil having the drawback of braking the balance and thus consuming energy. In the escapement of the present invention, there is no recoil since radius of curvature R1 of edge 14 of lever 5 is the same as radius of curvature R2 of first cut out portion 17 of tooth 8 of wheel 3 (see FIGS. 7 and 8).

It is further to be noted that the system proposed does not need to be lubricated. This is due to the contact surfaces which are reduced to the strict minimum both as regards the region where the impulse is given (edge 19 and cut out portion 18) and the region concerned by the release (cut out portion 17 of very small surface).

What is claimed is:

1. An escapement arranged between a gear train and a plate to which is attached a sprung balance of a timekeeper, the balance being able to travel through an arc of oscillation and receive impulses for maintaining the oscillations, this escapement including first and second toothed wheels meshing with each other, one of these wheels being driven by the gear train, said escapement further including a lever able to receive impulses generated alternately by the first and second wheels and to transmit these impulses to said plate to drive it in rotation and to maintain the balance oscillations, said lever being arranged to lock alternately said first and second wheels after each impulse transmitted, wherein said first and second toothed wheels each have only a single toothing, and wherein said lever is pivoted about an axis different from that of said balance.

2. An escapement according to claim 1, wherein the lever is supported by a shaft pivoting in a plate of the timekeeper, and wherein this lever has a substantially triangular shape a first top of which includes a first recess in which the end of a tooth of the first wheel can be introduced to subject the lever to an impulse in a first direction (A), a second top of which includes a second recess in which the end of a tooth of the second wheel can be introduced so as to subject the lever to an impulse in a second direction (B), opposite to the first direction, and a third top of which includes two teeth capable of meshing with a single tooth of the plate.

3. An escapement according to claim 2, wherein the first and second recesses of the lever are connected by an edge having a circular configuration whose radius of curvature (R1) passes through the axis of the shaft supporting the lever and in that each of the teeth of the first and second wheels has a front flank including a first curved top cut out portion, called the locking face, whose radius of curvature (R2) is substantially the same as that of the radius of curvature (R1) of the edge connecting the first and second recesses of the lever, said locking face being capable of abutting against said edge of the lever to lock one of said wheels, and a second cut out portion in the shape of an arc of a circle, called the impulse face, following the first cut out portion, said impulse face being capable of abutting against an edge defined by the intersection of said edge of the lever and one of said recesses to drive the lever in rotation.

4. An escapement according to claim 2, wherein each of the two teeth occupying the third top of the lever is dimensioned so as to be contiguous with the edge of the plate and thus to prevent the lever from overbanking during the balance's free oscillation arc travel.

5. An escapement according to claim 2, wherein the angular travel of the lever is limited by first and second horns located respectively at the first and second tops of said lever, the first horn being capable of abutting against the back flank of a tooth of the first wheel and the second horn being capable of abutting against the back flank of a tooth of the second wheel.

6. A escapement according to claim 2, wherein the angular travel of the lever is limited by two pins driven into the time-keeper plate.

* * * * *